United States Patent [19]

Allen et al.

[11] 4,030,234

[45] June 21, 1977

[54] FIGURE TOY PLAY KIT

[75] Inventors: Robert K. Allen, Hinsdale; Palmer J. Schoenfield, Evanston; Howard J. Morrison, Deerfield, all of Ill.

[73] Assignee: Marvin Glass & Associates, Chicago, Ill.

[22] Filed: Feb. 5, 1976

[21] Appl. No.: 655,419

[52] U.S. Cl. ..... 46/1 R; 46/12; 46/19; 46/116

[51] Int. Cl.[2] ..... A63H 3/52

[58] Field of Search ..... 46/1 R, 12, 19, 116

[56] References Cited

UNITED STATES PATENTS

| | | | |
|---|---|---|---|
| 1,034,586 | 8/1912 | Corrao | 46/1 R |
| 2,040,974 | 5/1936 | Bigelow | 46/12 |
| 2,872,753 | 2/1959 | Fenton | 46/12 |
| R26,642 | 8/1969 | Bender | 46/12 |

*Primary Examiner*—Russell R. Kinsey
*Assistant Examiner*—Robert F. Cutting
*Attorney, Agent, or Firm*—Mason, Kolehmainen, Rathburn & Wyss

[57] ABSTRACT

A play kit for the amusement and entertainment of a child in simulating outdoor activity while playing with a doll or other toy figurine. The kit includes a carrying case in the form of a free-standing gazebo having a hexagonal base. At each corner of the base an ornamental post upstands and is secured at its upper end to a hexagonal roof member for supporting the member above the base. Between one or more pairs of adjacent posts, low fence sections may be mounted as appearance improvement features and as functional members, e.g., providing support to the structure. A fold-down side panel is provided for each side of the hexagonal case for opening and closing the case. Each panel is secured to the base at a lower base edge thereof and has a fold line adjacent the base edge. When folded down, the panels provide horizontal platforms having upwardly facing platform surfaces as additional floor play area extending peripherally about the gazebo floor. One or more of the panels may have secured to its platform surface a play item or structure such as a hammock or a swing in which a doll may be positioned during play. When the panels are moved to their upright position enclosing the case, the hammock or swing is carried therewith to a position within the interior of the gazebo for storage purposes. Releasable latches are provided to retain the side panels in their upright positions while the case is being stored or transported.

15 Claims, 6 Drawing Figures

Fig 1
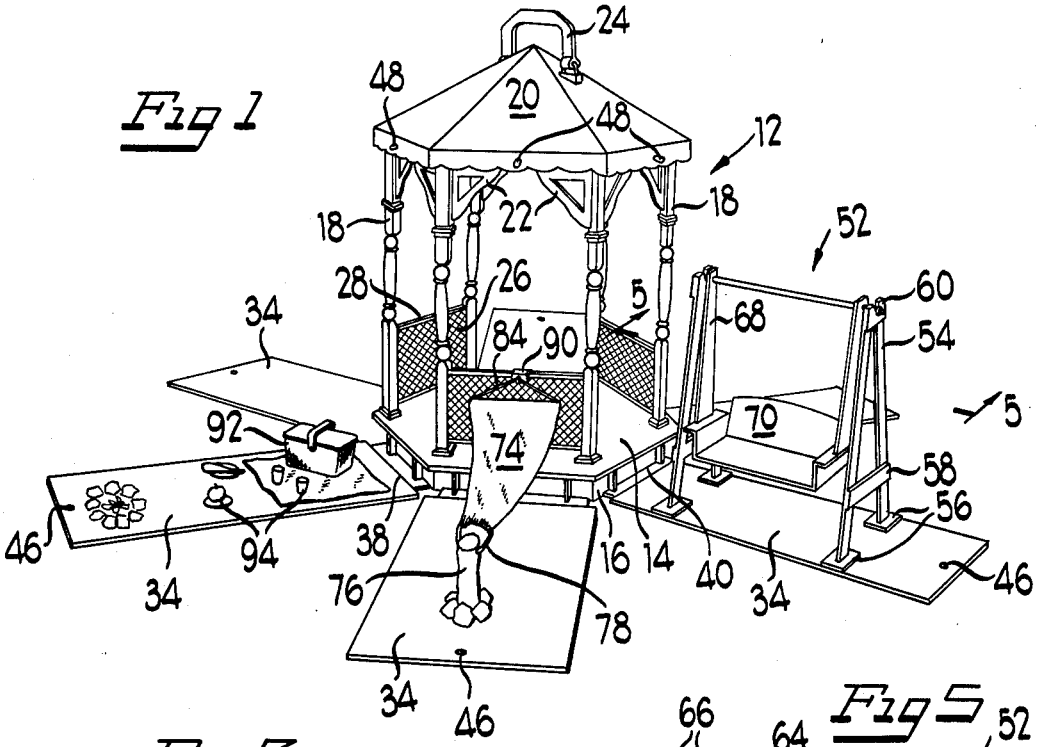
Fig 3
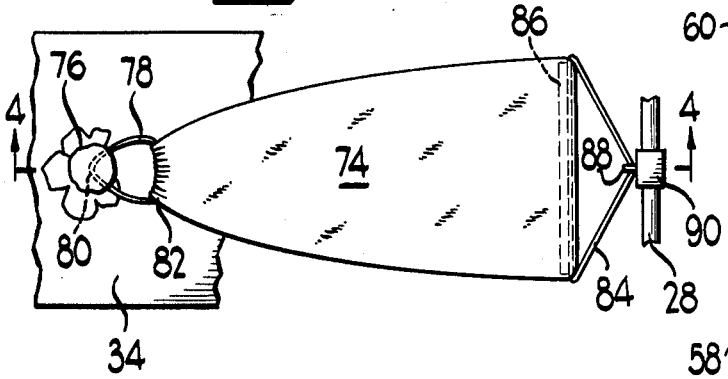
Fig 5
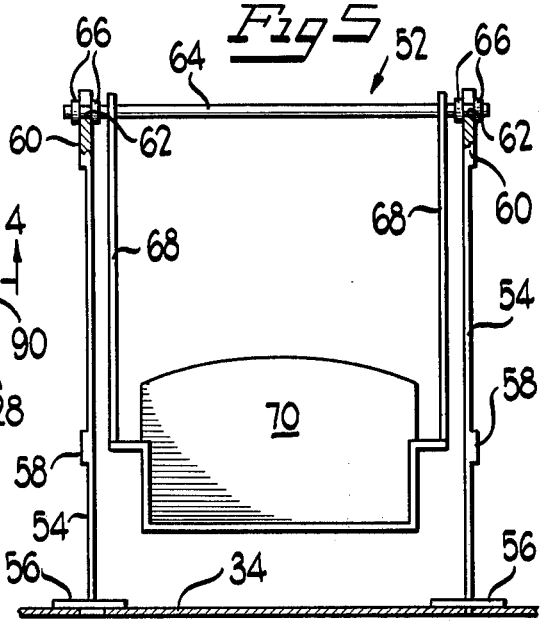
Fig 4
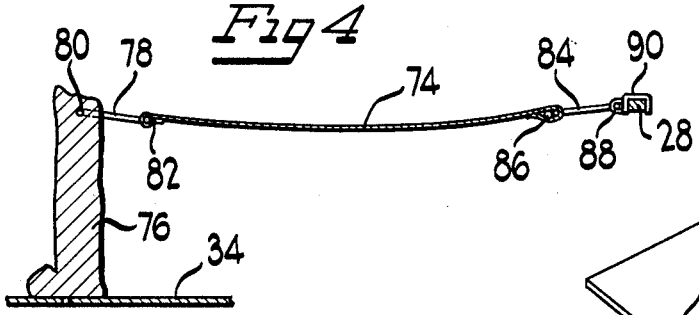
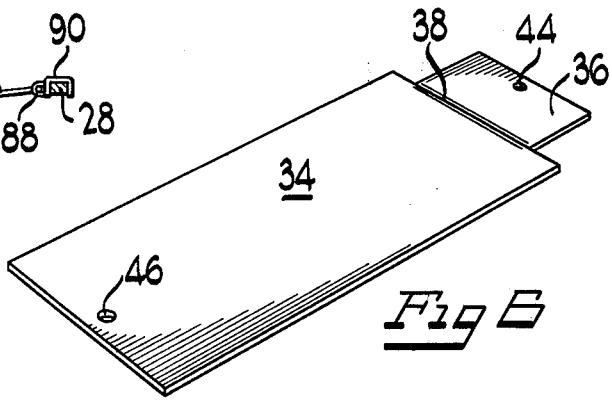
Fig 6

FIGURE TOY PLAY KIT

BACKGROUND OF THE INVENTION

The present invention relates to play kits to be used for the amusement of entertainment of a child while playing with a doll or other toy figure. More particularly, the invention relates to such a kit for use by the child in simulating outdoor activity involving the doll.

SUMMARY OF THE INVENTION

The present invention provides a child's amusement or entertainment device in the form of a kit including play items for use by the child when playing with a doll or other toy figure. The kit has a case which includes a base or bottom floor member, a plurality of posts upstanding therefrom and a top or roof member secured to and supported by the posts in a position spaced above the base member. A plurality of side wall panels are hingedly connected to the base member and are movable between an upright position forming the case walls and a platform position extending generally outwardly peripherally of the base to provide play areas. Latch means are provided for releasably retaining the side walls in their upright positions with the case in its closed condition. Play items may be kept or stored within the case.

In one advantageous form of the present invention, one or more of the side panels has a play item such as a hammock or swing secured to its platform surface so that when such panel is pivoted to its upright position, the play item is carried therewith into the interior of the case as the case is closed, and when the panel is pivoted downward to platform position, the toy is exposed for play. In the exemplary embodiment, the case is in the form of a six-sided gazebo and has six fold-down side panels. Low structural support fences can be mounted between adjacent pairs of posts for appearance effect enhancing the image of a gazebo, as well as for supporting play items during play.

While this invention is susceptible of embodiment in many different forms, there is shown in the drawings and will herein be described in detail a specific embodiment and modification thereof, with the understanding that the present disclosure is to be considered as an exemplification of the principles of the invention and is not intended to limit the invention to the embodiment illustrated.

BRIEF DESCRIPTION OF THE DRAWINGS

FIG. 1 is a perspective view of an embodiment of the kit of this invention in full open position exposing various play items for use by a child;

FIG. 3 is an enlarged fragmentary top view of a toy hammock which forms part of the kit of FIG. 1;

FIG. 4 is a section taken along line 4—4 of FIG. 3;

FIG. 5 is an enlarged sectional view taken generally along line 5—5 of FIG. 1 showing a toy swing; and FIG. 6 is an enlarged perspective view of a side panel used in the structure of the case of the embodiment shown in FIG. 1.

DETAILED DESCRIPTION OF THE PREFERRED EMBODIMENT

Figure 2:
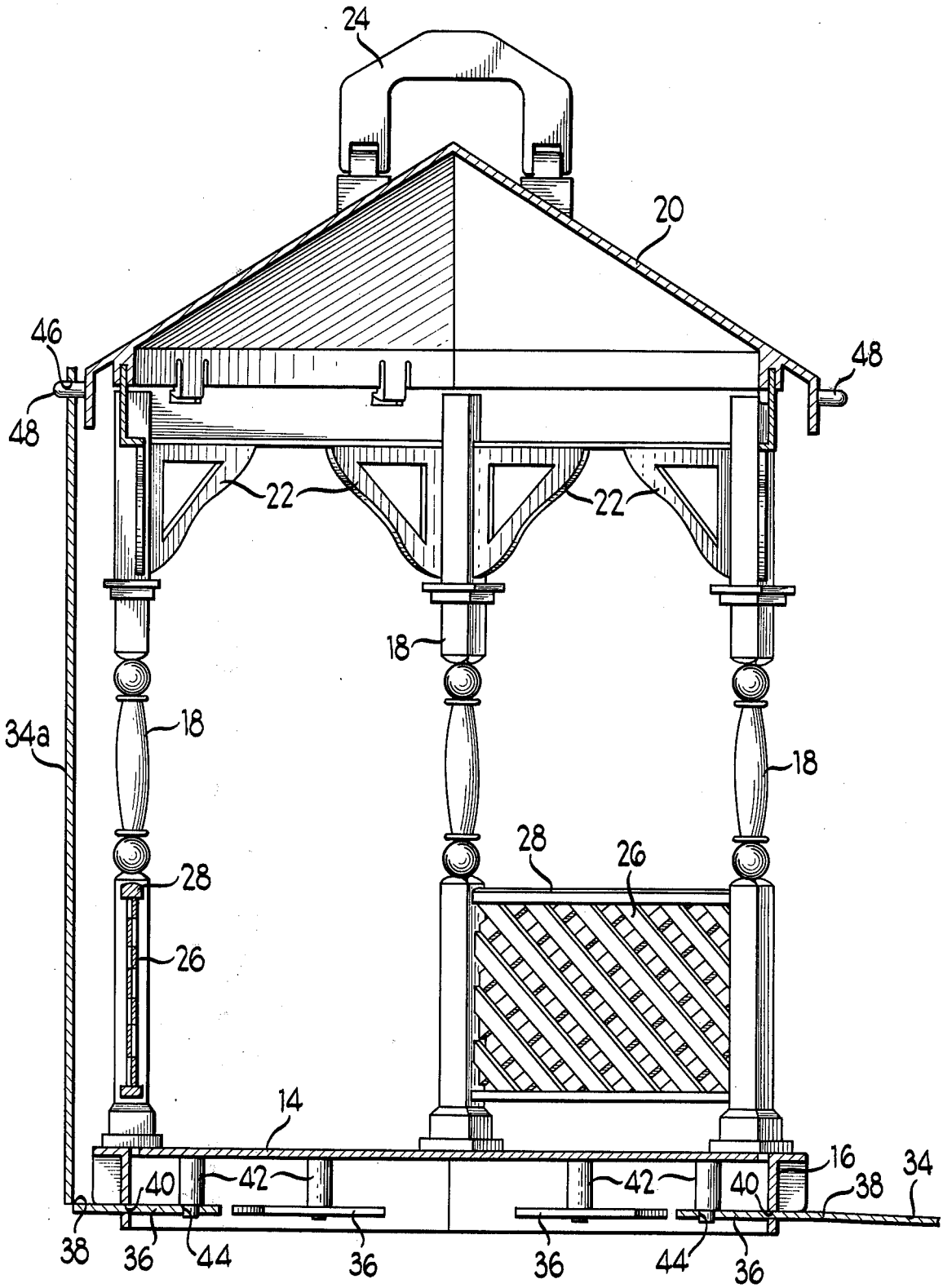
FIG. 2 is an enlarged fragmentary vertical sectional view through the kit shown in FIG. 1 but with the case in partially closed position.

Turning first to FIG. 1, the kit of the present invention includes a carrying case having a structure in the general form of a gazebo as shown generally at 12. The gazebo 12 includes a hexagonal base 14 (FIGS. 1 and 2) having a peripheral downwardly extending supporting skirt 16. A plurality of support members in the form of ornamental posts 18 are secured to an upstand from base 14, one in each corner of the hexagon. At their upper ends, posts 18 are secured to and support a hexagonical roof 20, spaced above and in general alignment with base 14. Ornamental and functional corner braces, as at 22, are provided to strengthen the connection of the posts 18 to the roof 20. Roof 20 has a manually grippable handle 24 secured to the top thereof so that the case can be more readily lifted and transported by a child. For purposes of adding structural strength and decoration to the gazebo structure, short fences 26 (FIGS. 1 through 4) having top rails 28 extend between and are secured at their opposite ends to some of the adjacent pairs of posts 18.

As best seen in FIGS. 1, 2 and 6, a plurality of side panels 34 are provided, one for covering each open side of the gazebo structure, for the purpose of completing the walls of the carrying case. Each side panel 34 has a reduced tongue portion 36 delineated by a fold line 38 at the bottom end of the side panel 34. As best seen in FIG. 2, each tongue portion 36 is received through a slot 40 in skirt 16, generally centered between a pair of posts 18. A depending finger 42 is secured and centrally located relative to the ends of each slot to base 14 and is received by and secured within a bore 44 in tongue 36 to secure tongue 36 against withdrawal through slot 40.

It will readily be seen that the side panels 34 can be folded along lines 38 from their platform positions as shown in FIG. 1 to their upright positions, such as shown in FIG. 2 at 34*a*. In upright position, bores 46 adjacent the upper ends of panels 34 receive, by snug or snap fit, pins 48 secured to the fringe of roof 20 to releasably latch and retain the panels 34 in their upright position.

Among the accessories included with the illustrated embodiment is a swing, shown generally at 52 (FIGS. 1 and 5). Swing 52 includes two pairs of supporting standards 54 having feet 56 secured to the platform surface of a panel 34. Cross bracing at 58 and 60 between standards in each pair help to strengthen the structure. A receiver 62 is formed at the junction of the cross braces 60 with the top portions of each pair of standards 54 for rotatably receiving a shaft 64 adjacent each end thereof. Pairs of circular flanges 66 on shaft 64 straddle the receivers 62 and hold shaft 64 against axial movement.

A pair of spaced parallel depending arms 68 are secured to shaft 64 for pivotal movement therewith. Arms 68 are secured at their lower ends to opposite ends of a swing seat 70 which is sized to receive a doll or the like.

Turning now to FIGS. 1, 3 and 4, a hammock 74 is provided as another accessory for the kit. One end of hammock 74 is supported by a stud post 76, illustrated for decorative purposes in the form of a tree stump. A ring 78 impales the post 76, at 80, and extends through and gathers a hem-like loop 82 to support one end of hammock 74.

At the other end of hammock 74, a triangular hanger bar 84 extends through a hem-like loop at 86 and through an eyelet element 88 of a hook 90 which is releasably hooked over and receives a rail 28 of one of the fences 26 to support the end of hammock 74.

Both the swing 52 and the hammock 74 are sized to be carried on their respective panels to the interior of the case as the case is closed. In the case of the hammock, the hook 90 should be removed from rail 28 before closing the panel to prevent any undue pressure damage to the panel platform surface by eyelet 88. Any needed further assistance to assure entry of the hammock fully into the case interior can easily be given.

Still another accessory provided in the kit is a miniaturized or toy picnic basket 92 and other toy picnic accessories 94, such as miniaturized cups, replicas of food, and the like, which may be removed from basket 92 for play by a child. The basket and accessories also can be stored inside the case.

The foregoing detailed description has been given for clearness of understanding only and no unnecessary limitations should be understood therefrom as some modifications will be obvious to those skilled in the art.

We claim:

1. A child's amusement device for child activity with a doll or other toy figure, comprising: a carrying case having a base; a roof; means supporting said roof spaced above said base and securing the roof and base as a unit; a plurality of individual side panels for said case, each side panel separately hingedly connected to the base and pivotally movable relative to the base between (1) a horizontal, open or platform position extending outwardly from the base periphery providing a generally horizontal play area and exposing the interior of the case, and (2) a closed or upright position forming at least a portion of the side wall of the case; a plurality of latch means for releasably holding each panel individually in its upright position with the case thereby closed; and doll play accessory means secured to the interior surface of at least one of said panels whereby the panel may be folded down from said upright position to said platform position to deliver the accessory means from the interior of the case to the exterior thereof for access and play by the child.

2. The device of claim 1 wherein the accessory means includes a miniature hammock for supporting a doll, said hammock having one end connected to one of said side panels and means securing the other end to the base.

3. The device of claim 1 wherein said accessory means includes a toy swing sized to receive a doll and secured to a panel for pivoting inwardly into the case.

4. The device of claim 1 including a miniature picnic basket and toy picnic accessories to be contained in the basket, said basket being sized to be stored within said case.

5. The device of claim 1 wherein said case is in the form of an upstanding hexagonal gazebo having six side panels, each side panel projecting radially outwardly when in said platform position.

6. The device of claim 5 wherein the accessory means includes a miniature hammock for supporting a doll, said hammock having one end connected to one of said side panels and means securing the other end to the base.

7. The device of claim 5 wherein said accessory means includes a toy swing sized to receive a doll and secured to a panel for pivoting inwardly into the case.

8. The device of claim 5 including a miniature picnic basket and toy picnic accessories to be contained in the basket, said basket being sized to be stored within said case.

9. A child's amusement device in the form of a play kit for child activity with a doll or other figure toy, comprising: a carrying case in the shape of a free standing gazebo, said carrying case having a hexagonal shaped base defining a floor and having six side edges, a hexagonal shaped roof, an upstanding post at each corner of the hexagonal base and supporting and spacing said roof above said base with the hexagonal shapes in substantial vertical registry; six side panels each separately hingedly connected to one of said base edges and pivotally movable relative to the base between a generally horizontal platform position forming an outward extension from said base and opening the case to expose the interior thereof, and a closed or upright position forming a side wall of the case; and latch means for releasably holding each panel in its upright position, whereby movement of the panels from their platform position to their upright position closes the case and can receive accessories on the interior thereof.

10. The device of claim 9 including a manually grippable handle pivotally mounted on the top of said roof for lifting and transporting said case.

11. The device of claim 9 including an upright fence section having a top rail joining at least one pair of adjacent posts generally parallel to an edge of said base.

12. The device of claim 9 including an upstanding post on one of said panels spaced from said fence section when the panel is in platform position, and a toy hammock secured between said posts and the upper rail of said fence section.

13. The device of claim 12 including hook means on one end of said hammock for releasably attaching said end to the top fence rail for swinging suspension of the hammock between the posts and the fence rail.

14. The device of claim 9 including a toy swing secured to and upstanding from one of said panels when in platform position and movable therewith to said closed position within said case.

15. The device of claim 9 including a plurality of picnic type accessories, including a toy picnic basket, for use in play on one of said panels or adjacent supporting surface and of a size to be positionable and storable within the case when said panels are moved to their upright position.

* * * * *